US010304280B1

(12) United States Patent
Halvorson

(10) Patent No.: US 10,304,280 B1
(45) Date of Patent: May 28, 2019

(54) GAMING SYSTEM AND METHOD INCLUDING INTERLEAVED REELS

(71) Applicant: ADP GAUSELMANN GMBH, Espelkamp (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/019,980

(22) Filed: Jun. 27, 2018

(51) Int. Cl.
*G07F 17/32* (2006.01)

(52) U.S. Cl.
CPC ..... *G07F 17/3213* (2013.01); *G07F 17/3216* (2013.01); *G07F 17/3267* (2013.01); *G07F 17/3269* (2013.01)

(58) Field of Classification Search
CPC ..... G07F 17/34
See application file for complete search history.

(56) References Cited

U.S. PATENT DOCUMENTS

2008/0090636 A1* 4/2008 Lathrop ..... G07F 17/34 463/20
2013/0122988 A1* 5/2013 Guinn ..... G07F 17/3211 463/20
2014/0004924 A1* 1/2014 Lerias, III ..... G07F 17/326 463/20

* cited by examiner

*Primary Examiner* — Robert T Clarke, Jr.
(74) *Attorney, Agent, or Firm* — Resolute Legal PLLC

(57) ABSTRACT

Various embodiments of a gaming system and method comprise interleaved slot machine reels. The gaming system generates a plurality of symbols on a plurality of reels, where at least some of the plurality of reels are interleaved with each other. In some embodiments, the gaming system generates and displays a first plurality of reels in a first angled direction and a second plurality of reels in a second different angled direction. Some of the first plurality of reels are interleaved (or overlap) with some of the second plurality of reels. In some embodiments, the gaming system generates one or more reels that display one symbol, where the gaming system generates these one symbol display reels between the interleaved reels.

20 Claims, 12 Drawing Sheets

GAMING SYSTEM AND METHOD INCLUDING INTERLEAVED REELS

FIELD OF THE INVENTION

The present disclosure relates to gaming devices.

BACKGROUND OF THE INVENTION

Gaming machines that accept wagers in exchange for the opportunity to win awards or prizes are known. Gaming machines that offer new ways to win awards or prizes are needed to gain and retain players' interest in the gaming machines.

SUMMARY OF THE INVENTION

Various embodiments of a gaming system and method comprise interleaved slot machine reels. The gaming system generates a plurality of symbols on a plurality of slot machine reels (e.g., reels), where at least some of the plurality of reels are interleaved with each other. In some embodiments, the gaming system generates and displays a first plurality of reels in a first angled direction and a second plurality of reels in a second different angled direction. Some of the first plurality of reels are interleaved (or overlap) with some of the second plurality of reels. In some embodiments, the gaming system generates one or more reels that display one symbol, where the gaming system generates these one symbol display reels between the interleaved reels. The gaming system evaluates pay lines that span across the interleaved reels for winning symbol combinations. A gaming system having interleaved reels allows more reels and more symbols to be displayed than is possible on a standard gaming system display, without having to use a larger display or substantially shrink the size of the displayed symbols. A gaming system having interleaved reels also enables the use of a variety of new pay lines that were not previously possible, such as vertical pay lines and pay lines that can start from any border or side around displayed symbols.

In one embodiment, a gaming system includes a plurality of symbol display areas associated with a plurality of video based slot machine reels. In one embodiment, the gaming system generates a first plurality of reels oriented in a first direction, a second plurality of reels oriented in a second direction, and a third plurality of reels oriented in a third direction. In some embodiments, the first direction is an angled orientation across a display of the gaming system. In some embodiments, the second direction is a different angled orientation across the display of the gaming system that is substantially perpendicular to the first direction. In some embodiments, at least one of the first plurality of reels is interleaved with at least one of the second plurality of reels. In some embodiments, the interleaved reels may cross over or under one or more other reels. In some embodiments, the third direction is substantially vertical. In some embodiments, the gaming system generates the third plurality of reels in display areas that are in unoccupied display areas left by the interleaved first plurality of reels and the second plurality of reels.

In some embodiments, the gaming system generates and displays two symbols for some of the first plurality of reels and generates and displays four symbols for other of the first plurality of reels. In some embodiments, the gaming system generates and displays one symbol for some of the second plurality of reels and generates and displays three symbols for other of the second plurality of reels. In some embodiments, the gaming system generates and displays one symbol for the third plurality of reels. The gaming system displays the first plurality of reels spinning in a first direction, the second plurality of reels spinning in a second direction, and the third plurality of reels spinning in a third direction, wherein the first, second, and third directions are all different directions from each other in some embodiments. In some embodiments, some or all of the first, second, and third directions can be in the same direction.

The gaming system further includes a plurality of symbol sets that each includes a plurality of symbols. In some embodiments, each reel from the first plurality of reels is associated with one of the plurality of symbol sets, each reel from the second plurality of reels is associated with one of the plurality of symbol sets, and each reel from the third plurality of reels is associated with one of the plurality of symbol sets. In various embodiments, the each of the reels from all three plurality of reel sets may be associated with the same symbol set from the plurality of symbol sets or with different symbol sets from the plurality of symbol sets.

For a play of a game, for each slot machine reel, the gaming system generates a plurality of symbols from the associated symbol set for the reel. The gaming system evaluates the generated plurality of symbols for winning symbol combinations along wagered pay lines. In some embodiments, the pay lines can be formed from any side or border of the game display. In some embodiments, the pay lines can be formed from the top or the bottom sides of a game display (e.g., the gaming system can evaluate the pay lines from the top or bottom sides of the game display). In some embodiments, the pay lines can be formed from the left or right sides of a game display (e.g., the gaming system can evaluate the pay lines from the left or right sides of the game display). The gaming system determines and provides a payout amount based on winning symbol combinations along wagered pay lines.

The gaming system also evaluates the generated plurality of symbols for triggering symbol combinations. If the gaming system determines that a triggering symbol combination was generated, the gaming system starts and executes a bonus game. The bonus game may comprise a reel layout similar to the base game. In other embodiments, the bonus game may be different game. The gaming system may determine and provides a payout amount in accordance with the bonus game outcome.

In some embodiments, where the gaming system comprises interleaved reels, at least two of the plurality of interleaved reels share at least one symbol (e.g., display areas on each of the interleaved reels that are overlapping).

In alternative embodiments of the gaming system comprising interleaved reels, at least two of the plurality of reels share a same symbol display area, but do not share a symbol in the same symbol display area. That is, in such alternative embodiments, the gaming system may generate a first symbol for the same symbol display area for a first interleaved reel and also generate a second symbol for the same symbol display area for a second interleaved reel. In some embodiments, only one of the first symbol or the second symbol is visible. In alternative embodiments, both the first symbol and the second symbol are at least partially visible. In some embodiments, the gaming system uses one of the first symbol or the second symbol for evaluating winning symbol combinations. In some embodiments, the gaming system uses both of the first symbol and the second symbol in different and separate evaluations of winning symbol combinations.

In some embodiments of the gaming system, in the overlapping display area at which two of the plurality of reels are interleaved (or overlap), the overlapping display area is in the center of one of a first plurality of reels or a second plurality of reels. In some embodiments of the gaming system, the area at which two of the plurality of reels are interleaved or overlap, the overlapping display area is in an end display area of both of the interleaved reels.

In some embodiments, the gaming system generates one reel that is interleaved with two other reels of the plurality of reels. In some embodiments, the gaming system generates one reel that is interleaved with more than two other reels of the plurality of reels. In some embodiments, the gaming system generates at least two reels of the plurality of reels that are interleaved with at least two other reels of the plurality of reels.

In some embodiments, the gaming system generates one of the third plurality of reels substantially surrounded by four different adjacent reels, wherein two of the four different adjacent reels are reels from the first plurality of reels and the other two of the four different adjacent reels are reels from the second plurality of reels. In some embodiments, the gaming system generates and displays one of the third plurality of reels substantially surrounded by four different adjacent reels and generates and displays another one of the third plurality of reels substantially surrounded by three different adjacent reels. In some such embodiments, two of the four different adjacent reels are reels from the first plurality of reels and the other two of the four different adjacent reels are reels from the second plurality of reels. In some such embodiments, at least one of the three different adjacent reels is a reel from the first plurality of reels and at least one other of the three different adjacent reels is a reel from the second plurality of reels. In some embodiments, the gaming system comprises at least one pay line to evaluate winning symbol combinations that spans across at least two reels of the third plurality of reels.

In one embodiment, one of the plurality of reels from the first plurality of reels or the second plurality of reels is a continuous reel that intersects another one of the other plurality of reels at least twice. In such an embodiment, the gaming system may generate and display more symbols for the continuous reel than for other displayed reels. In some embodiments with a continuous reel, the gaming system may evaluate the generated and displayed plurality of symbols further using at least one pay line that spans across two different symbols displayed on the continuous reel. In some embodiments, the gaming system generates two or more continuous reels.

By using interleaved reels, the gaming system provides new ways to enhance game outcomes and improve player awards, which reduces potential player disappointment with game outcomes and enhances player excitement for the game. The new potential to improve or earn greater awards creates a greatly improved sense of anticipation of the game for players.

DETAILED DESCRIPTION OF THE INVENTION

Figure 1:
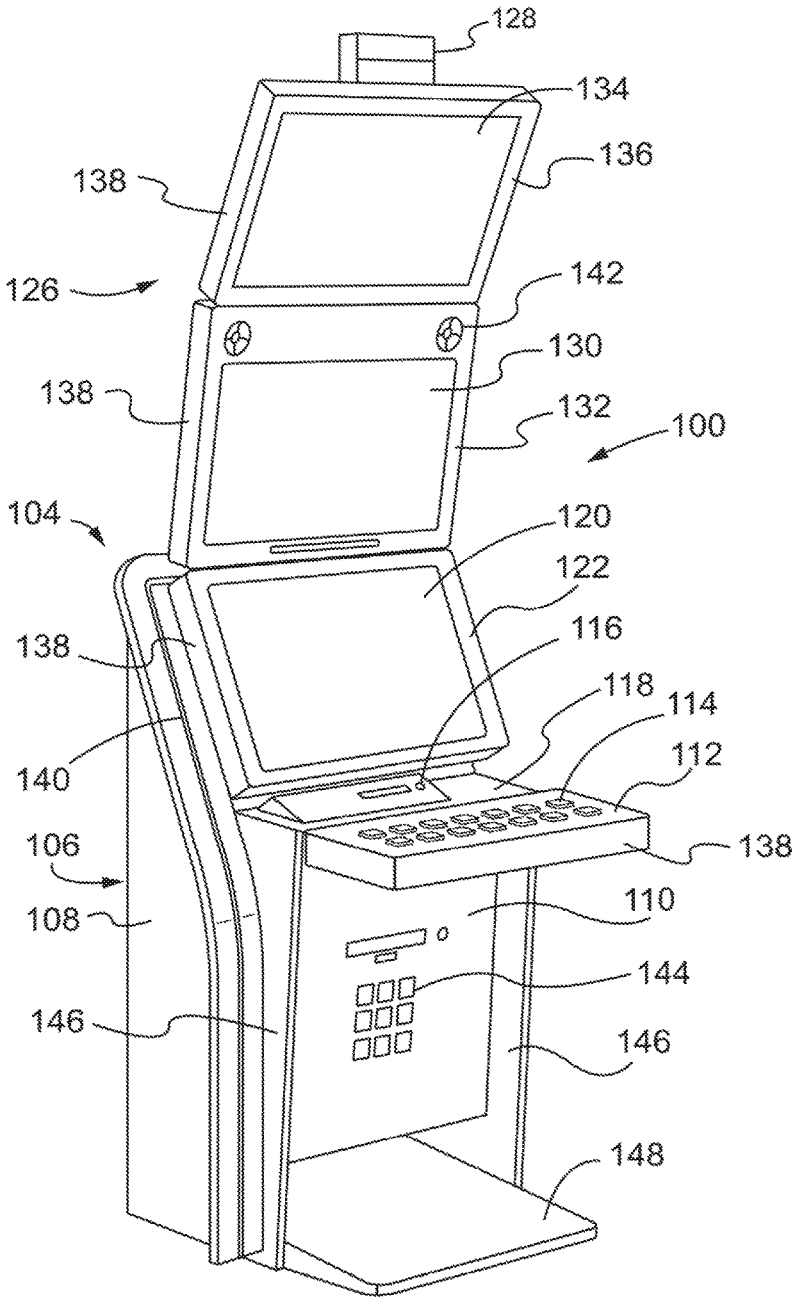
FIG. 1 is a perspective view of one embodiment of a stand-alone gaming device of a gaming system.

Various embodiments of a gaming system and method comprise interleaved slot machine reels. The gaming system generates a plurality of symbols on a plurality of slot machine reels (e.g., reels), where at least some of the plurality of reels are interleaved with each other. In some embodiments, the gaming system generates and displays a first plurality of reels in a first angled direction and a second plurality of reels in a second different angled direction. Some of the first plurality of reels are interleaved (or overlap) with some of the second plurality of reels. In some embodiments, the gaming system generates one or more reels that display one symbol, where the gaming system generates these one symbol display reels between the interleaved reels. The gaming system evaluates pay lines that span across the interleaved reels for winning symbol combinations. A gaming system having interleaved reels allows more reels and more symbols to be displayed than is possible on a standard gaming system display, without having to use a larger display or substantially shrink the size of the displayed symbols. A gaming system having interleaved reels also enables the use of a variety of new pay lines that were not previously possible, such as vertical pay lines and pay lines that can start from any border or side around displayed symbols.

In one embodiment, a gaming system includes a plurality of symbol display areas associated with a plurality of video based slot machine reels. In one embodiment, the gaming system generates a first plurality of reels oriented in a first direction, a second plurality of reels oriented in a second direction, and a third plurality of reels oriented in a third direction. In some embodiments, the first direction is an angled orientation across a display of the gaming system. In some embodiments, the second direction is a different angled orientation across the display of the gaming system that is substantially perpendicular to the first direction. In some embodiments, at least one of the first plurality of reels is interleaved with at least one of the second plurality of reels. In some embodiments, the interleaved reels may cross over or under one or more other reels. In some embodiments, the third direction is substantially vertical. In some embodiments, the gaming system generates the third plurality of reels in display areas that are in unoccupied display areas left by the interleaved first plurality of reels and the second plurality of reels.

In some embodiments, the gaming system generates and displays two symbols for some of the first plurality of reels and generates and displays four symbols for other of the first plurality of reels. In some embodiments, the gaming system generates and displays one symbol for some of the second plurality of reels and generates and displays three symbols for other of the second plurality of reels. In some embodiments, the gaming system generates and displays one symbol for the third plurality of reels. The gaming system displays the first plurality of reels spinning in a first direction, the second plurality of reels spinning in a second direction, and the third plurality of reels spinning in a third direction, wherein the first, second, and third directions are all different directions from each other in some embodiments. In some embodiments, some or all of the first, second, and third directions can be in the same direction.

The gaming system further includes a plurality of symbol sets that each includes a plurality of symbols. In some embodiments, each reel from the first plurality of reels is associated with one of the plurality of symbol sets, each reel from the second plurality of reels is associated with one of the plurality of symbol sets, and each reel from the third plurality of reels is associated with one of the plurality of symbol sets. In various embodiments, the each of the reels from all three plurality of reel sets may be associated with the same symbol set from the plurality of symbol sets or with different symbol sets from the plurality of symbol sets.

For a play of a game, for each slot machine reel, the gaming system generates a plurality of symbols from the associated symbol set for the reel. The gaming system evaluates the generated plurality of symbols for winning symbol combinations along wagered pay lines. In some embodiments, the pay lines can be formed from any side or border of the game display. In some embodiments, the pay lines can be formed from the top or the bottom sides of a game display. In some embodiments, the pay lines can be formed from the left or right sides of a game display. The gaming system determines and provides a payout amount based on winning symbol combinations along wagered pay lines.

The gaming system also evaluates the generated plurality of symbols for triggering symbol combinations. If the gaming system determines that a triggering symbol combination was generated, the gaming system starts and executes a bonus game. The bonus game may comprise a reel layout similar to the base game. In other embodiments, the bonus game may be different game. The gaming system may determine and provides a payout amount in accordance with the bonus game outcome.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
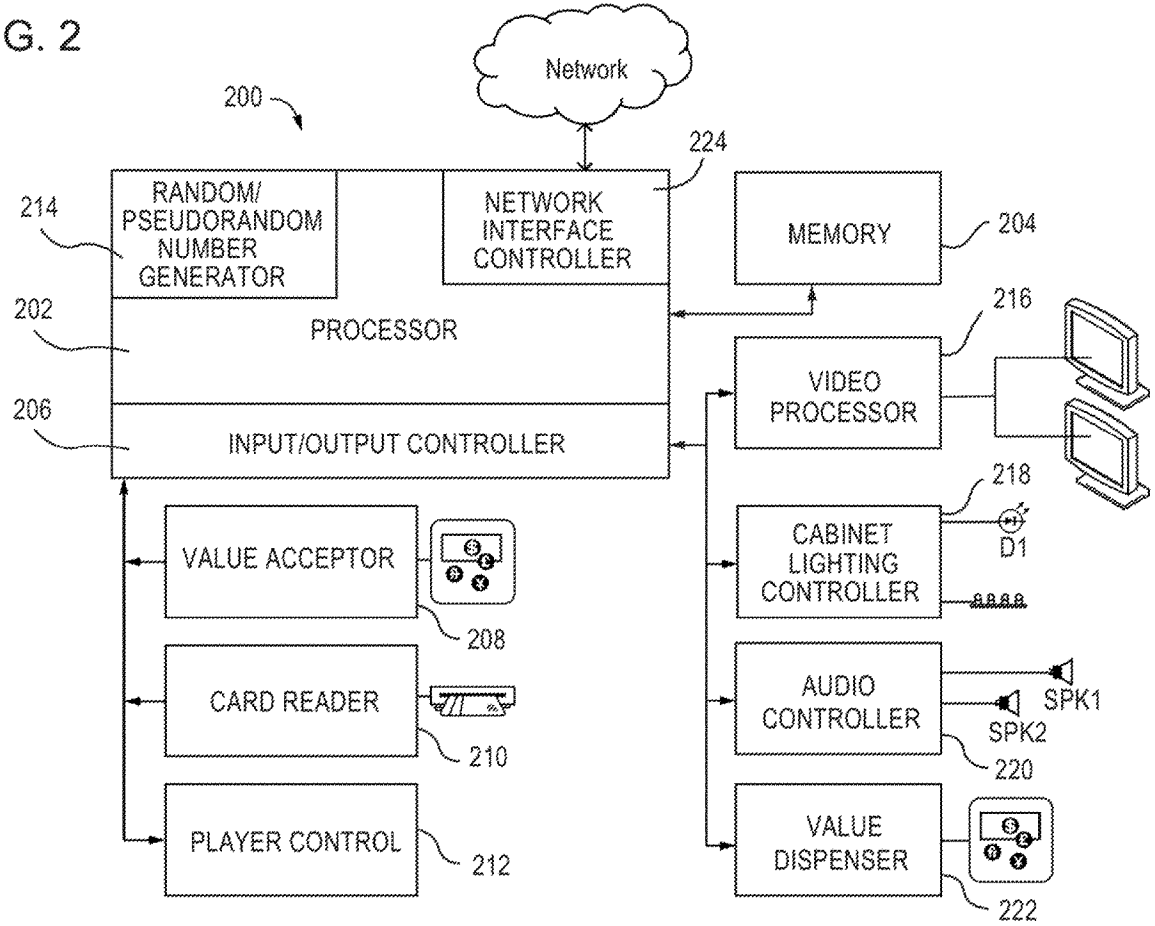
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202. In some embodiments, the random number generator may be located in a central server or a server that is remote from the gaming device 100. The gaming device 100 may receive the randomly generated values from the central server or remote server.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Operation

Figure 3A:
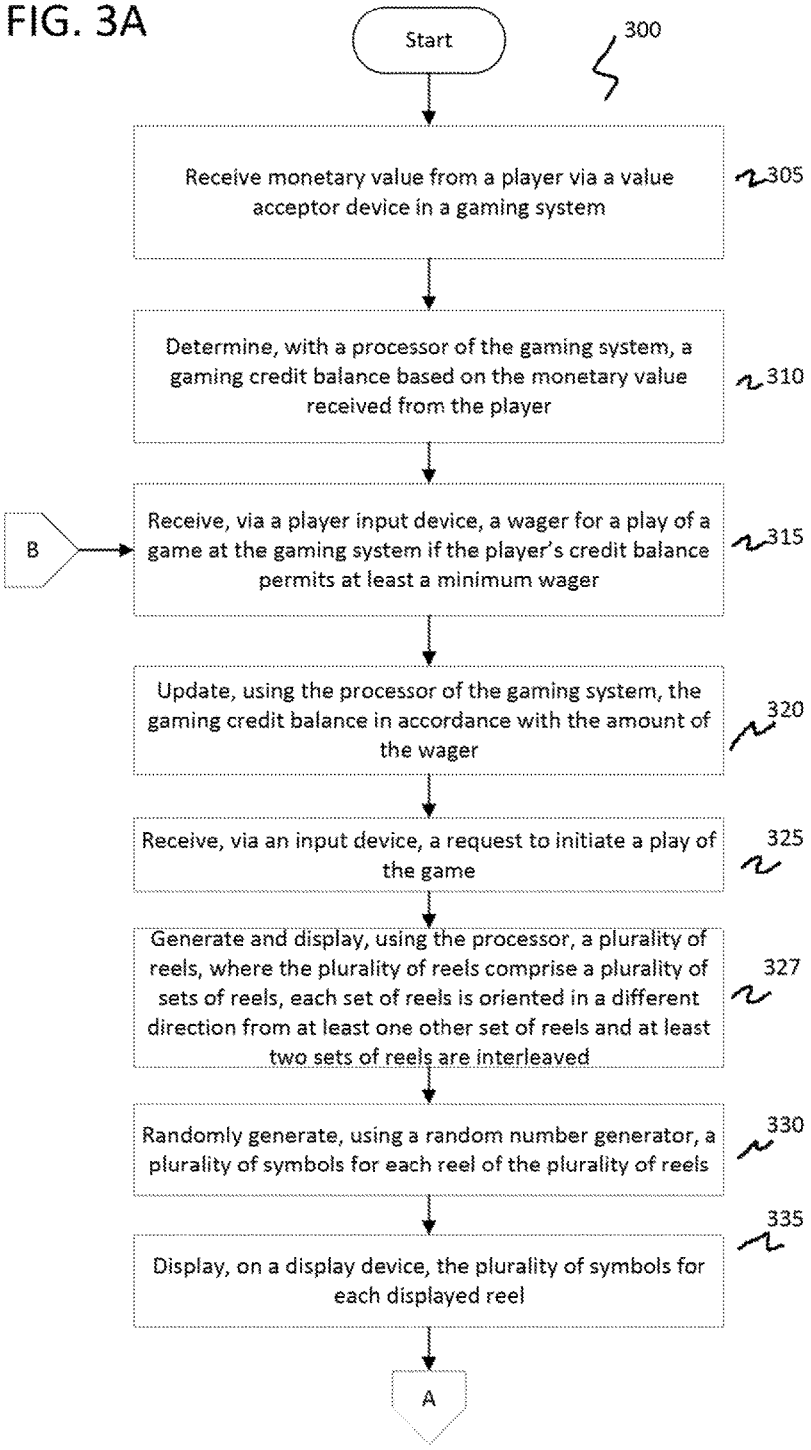
FIGS. 3A and 3B illustrate one embodiment of a method of operating the gaming system having interleaved reels.
Figure 3B:
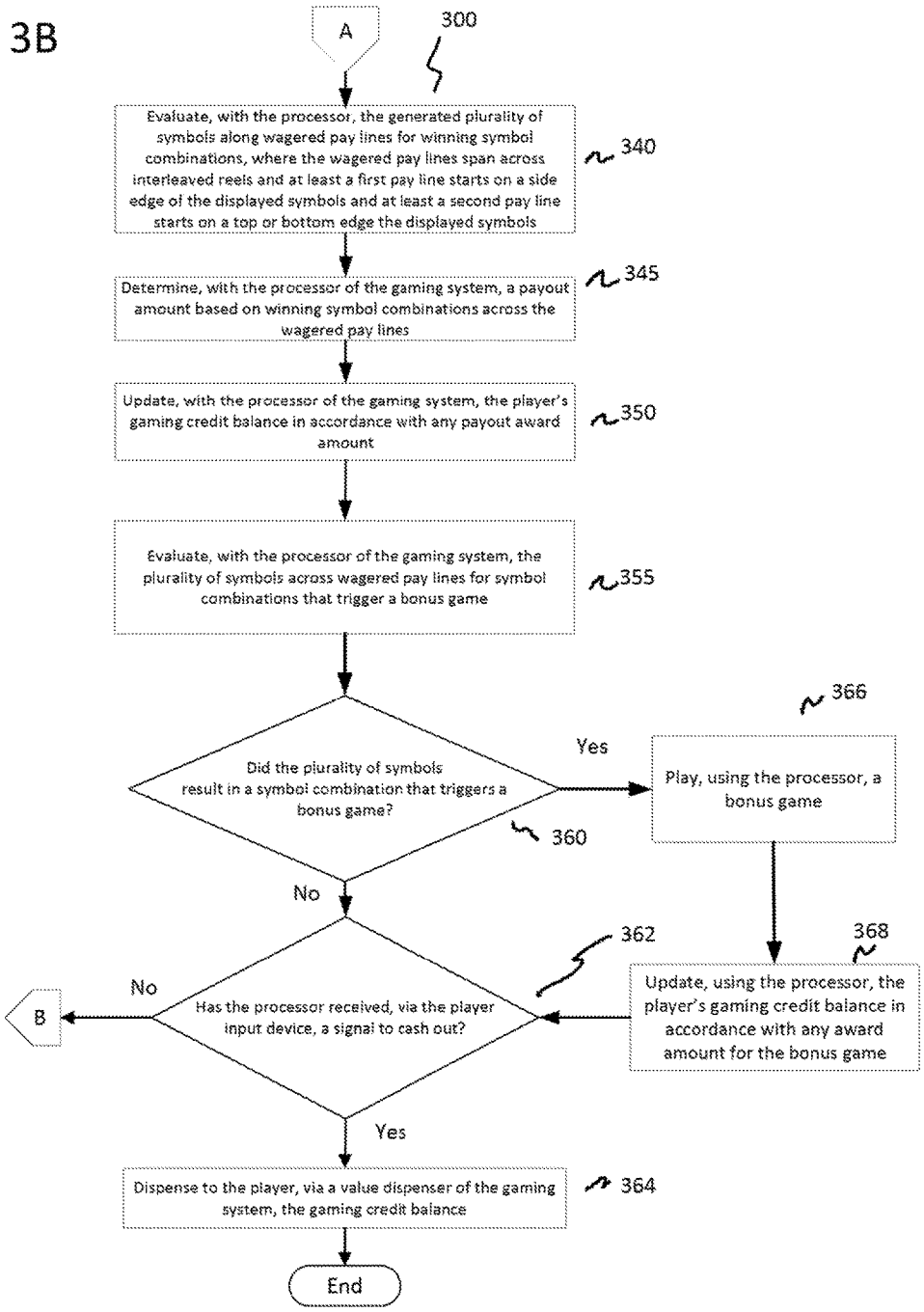

FIGS. 3A and 3B illustrate a flowchart of an example operation 300 of one embodiment of the gaming system and method. FIGS. 3A and 3B are depicted as a base or primary game while. However, it should be appreciated that the features described in connection with FIGS. 3A and 3B may be integrated as part of a bonus game.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions (e.g., symbol display areas) on reels in a game in which to place wagers. Although in some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In some embodiments, the gaming system generates and displays a plurality of reels on a display device as illustrated in block 327. In some embodiments, the plurality of reels comprise a plurality of sets of reels. In some embodiments, the reels in a set of reels are oriented in substantially the same angled direction. In some embodiments, the different sets of reels are oriented in different angled directions and some of the reels of at least two sets of reels are interleaved. For example, the gaming system may generate a first set of reels of the plurality of sets of reels at an angle downward from the left side of the display screen to the right side of the display screen in one embodiment. The gaming system may generate a second set of reels of the plurality of sets of reels at an angle upwards from the left side of the display screen to the right side of the display screen in some embodiments. In some embodiments, some of the first set of reels and some of the second set of reels are interleaved with each other. In some embodiments, some of the interleaved reels cross over at least one other interleaved reel while some of the interleaved reels cross under at least one other interleaved reel. In some embodiments, some of the interleaved reels cross over a plurality of other interleaved reels. In some embodiments, some of the interleaved reels cross under a plurality of other interleaved reels. In some embodiments, the gaming system may generate a third set of reels of the plurality of sets of reels that are positioned in display areas between at least some of the interleaved reels of the first set of reels and the second set of reels. It should be appreciated that the gaming system may generate any suitable number of reels and any suitable number of different sets of reels.

In one embodiment, the gaming system may use a random number generator to randomly generate a plurality of symbols from a plurality of symbol sets as indicated in block 330. The gaming system generates the plurality of symbols for each reel of the plurality of reels. In some such embodiments, each reel of the plurality of reels is associated with its own set of symbols. As used herein, the random number generation may refer to pseudo-random or true-random number generation depending on the module used for the random number generation.

In one embodiment, the gaming system may cause a display device to display the plurality of symbols generated for the plurality of reels as indicated in block 335. In a game using reels, the gaming system may display the generated plurality of symbols in visible symbol display areas of each of the reels. Off page connector A refers to FIG. 3B to continue operation 300.

Turning now to FIG. 3B and off page connector A, in one embodiment as shown in block 340, the gaming system evaluates with a processor, the generated plurality of symbols along active or wagered pay lines for winning symbol combinations. Due to the unique layout of the displayed plurality of reels, the wagered pay lines may span across interleaved reels and non-interleaved reels in some embodiments. In some embodiments, the wagered pay lines may be substantially vertically oriented across interleaved reels and non-interleaved reels. In some embodiments, at least a first pay line starts on a side edge (right or left) of the displayed symbols and at least a second pay line starts on a top or bottom edge the displayed symbols. In some embodiments, the gaming system may comprise wagered pay lines that can start and end on any side edge of the displayed symbols. In some embodiments, the gaming system may comprise a plurality of wagered pay lines that can start and end on a plurality of different side edges of the displayed symbols in some embodiments. In some embodiments, the gaming system may comprise pay lines that span across the displayed symbols in any number of different shapes. In some embodiments, the gaming system may comprise pay lines that can be limited to crossing a displayed reel only once. In alternative embodiments, the gaming system may comprise pay lines that may cross a displayed reel more than once.

In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment using reels, the gaming system determines an award amount based on winning symbol combinations formed across the reels on active pay lines. For example, if a pay table associated with the gaming system indicated that at least three of the same cherry symbols is a winning symbol combination and awards a predetermined payout, the gaming system would evaluate the generated plurality of symbols for consecutive or adjacent cherry symbols. If the gaming system generated at least three cherry symbols on adjacent reels and along an active pay line, the gaming system may determine that the three cherry symbols is a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

In block 345, the gaming system determines, with the processor, a payout amount based on the evaluated winning symbol combinations across wagered pay lines. As illustrated in block 350, the gaming system may update, with the processor, the player's gaming credit balance in accordance with any award amount. As noted above, the blocks illustrated in FIGS. 3A and 3B can be rearranged in any suitable order. As such, it should be appreciated that the gaming system may update player's gaming credit balance at other suitable times.

In one embodiment, as indicated in block 355, the gaming system evaluates the plurality of symbols across wagered pay lines for symbol combinations that trigger a bonus game with a predetermined quantity of spins (or activations, where the bonus game does not use slot reels). In some embodiments the symbol or symbol combinations that trigger the bonus game do not need to appear on wagered pay lines. In some embodiments, the predetermined quantity of spins are provided as free spins. In other embodiments, the player may pay to obtain the predetermined quantity of spins. It should also be appreciated that in some embodiments, events other than generating one or more of a predetermined symbol may trigger the bonus game.

If the gaming system determines that the generated plurality of symbols did not result in triggering a bonus game, in block 360, operation 300 moves to block 362. In one embodiment, as indicated in block 362, the gaming system may receive a signal to end game play or "cash out" via an input device of the gaming system. In such a situation, the gaming system dispenses a value to the player, through a value dispenser, based on the player's gaming credit balance as illustrated in block 364 and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

Returning to block 360, if the gaming system determines that the generated plurality of symbols resulted in trigging a bonus game, operation 300 moves to block 366. The gaming system or player may initiate the play of the bonus game as illustrated in block 366. The gaming system may securely access game data from a memory device and execute an authentication routine on the game data to start a play of the bonus game as discussed above. For example, the player may press a spin button on the gaming system to start spinning slot machine reels of the gaming system (or randomly generating symbols using other methods discussed above for virtual reels) for the play of the bonus game. In other example embodiments, the gaming system may automatically start or activate a play of the bonus game. It should further be appreciated that although the examples illustrated in the specification describe the games in terms of slot machines with reels, other games may be used, including games without slot machine reels.

In some embodiments, the gaming system alters the play of the game during the bonus game. In some embodiments, the gaming system may change how symbols operate. In some embodiments, the gaming system may use different pay tables in the bonus game to calculate winning symbol combinations. In some embodiments, the gaming system may use the same pay tables in the base game and the bonus game to calculate winning symbol combinations. In some embodiments, the bonus game can be a similar game to the base game. In some embodiments, the bonus game is a video slot reel game with a plurality of slot reels. It should also be appreciated that in some embodiments, the gaming system does not include a bonus game.

In one embodiment, at the conclusion of the bonus game, as illustrated in block 368, the gaming system determines an award amount for the bonus game and updates the player's gaming credit balance in accordance with any determined award amount and returns to block 362.

As indicated in block 362, the gaming system may receive a signal to end game play or "cash out" via an input device of the gaming system in some embodiments. In such a situation, the gaming system dispenses a value to the player, through a value dispenser, based on the player's gaming credit balance as illustrated in block 364 and operation 300 ends.

On the other hand, if the gaming system processor has not received a signal to end game play via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

In some embodiments, where the gaming system comprises interleaved reels, at least two of the plurality of interleaved reels share at least one symbol (e.g., display areas on each of the interleaved reels that are overlapping).

In alternative embodiments of the gaming system comprising interleaved reels, at least two of the plurality of reels share a same symbol display area, but do not share a symbol in the same symbol display area. That is, in such alternative embodiments, the gaming system may generate a first symbol for the same symbol display area for a first interleaved reel and also generate a second symbol for the same symbol display area for a second interleaved reel. In some embodiments, only one of the first symbol or the second symbol is visible. In alternative embodiments, both the first symbol and the second symbol are at least partially visible. In some embodiments, the gaming system uses one of the first symbol or the second symbol for evaluating winning symbol combinations. In some embodiments, the gaming system uses both of the first symbol and the second symbol in different and separate evaluations of winning symbol combinations.

In some embodiments of the gaming system, in the overlapping display area at which two of the plurality of reels are interleaved (or overlap), the overlapping display area is in the center of one of a first plurality of reels or a second plurality of reels. In some embodiments of the gaming system, the area at which two of the plurality of reels are interleaved or overlap, the overlapping display area is in an end display area of both of the interleaved reels.

In some embodiments, the gaming system generates one reel that is interleaved with two other reels of the plurality of reels. In some embodiments, the gaming system generates one reel that is interleaved with more than two other reels of the plurality of reels. In some embodiments, the gaming system generates at least two reels of the plurality of reels that are interleaved with at least two other reels of the plurality of reels.

In some embodiments, the gaming system generates one of the third plurality of reels substantially surrounded by four different adjacent reels, wherein two of the four different adjacent reels are reels from the first plurality of reels and the other two of the four different adjacent reels are reels from the second plurality of reels. In some embodiments, the gaming system generates and displays one of the third plurality of reels substantially surrounded by four different adjacent reels and generates and displays another one of the third plurality of reels substantially surrounded by three different adjacent reels. In some such embodiments, two of the four different adjacent reels are reels from the first plurality of reels and the other two of the four different adjacent reels are reels from the second plurality of reels. In some such embodiments, at least one of the three different adjacent reels is a reel from the first plurality of reels and at least one other of the three different adjacent reels is a reel from the second plurality of reels. In some embodiments, the gaming system comprises at least one pay line to evaluate winning symbol combinations that spans across at least two reels of the third plurality of reels. In some embodiments, two or more of the third plurality of reels can form a reel with at least two symbol display areas.

In some embodiments, the gaming system comprises more than or fewer than the three different sets of the plurality of reels.

In one embodiment, one of the plurality of reels from the first plurality of reels or the second plurality of reels is a continuous reel that intersects another one of the other plurality of reels at least twice. In such an embodiment, the gaming system may generate and display more symbols for the continuous reel than for other displayed reels. In some embodiments with a continuous reel, the gaming system may evaluate the generated and displayed plurality of symbols further using at least one pay line that spans across two different symbols displayed on the continuous reel. In some embodiments, the gaming system generates two or more continuous reels.

FIGS. 4A-4F illustrate screen shots of one embodiment of a gaming system having interleaved reels.

Figure 4A:
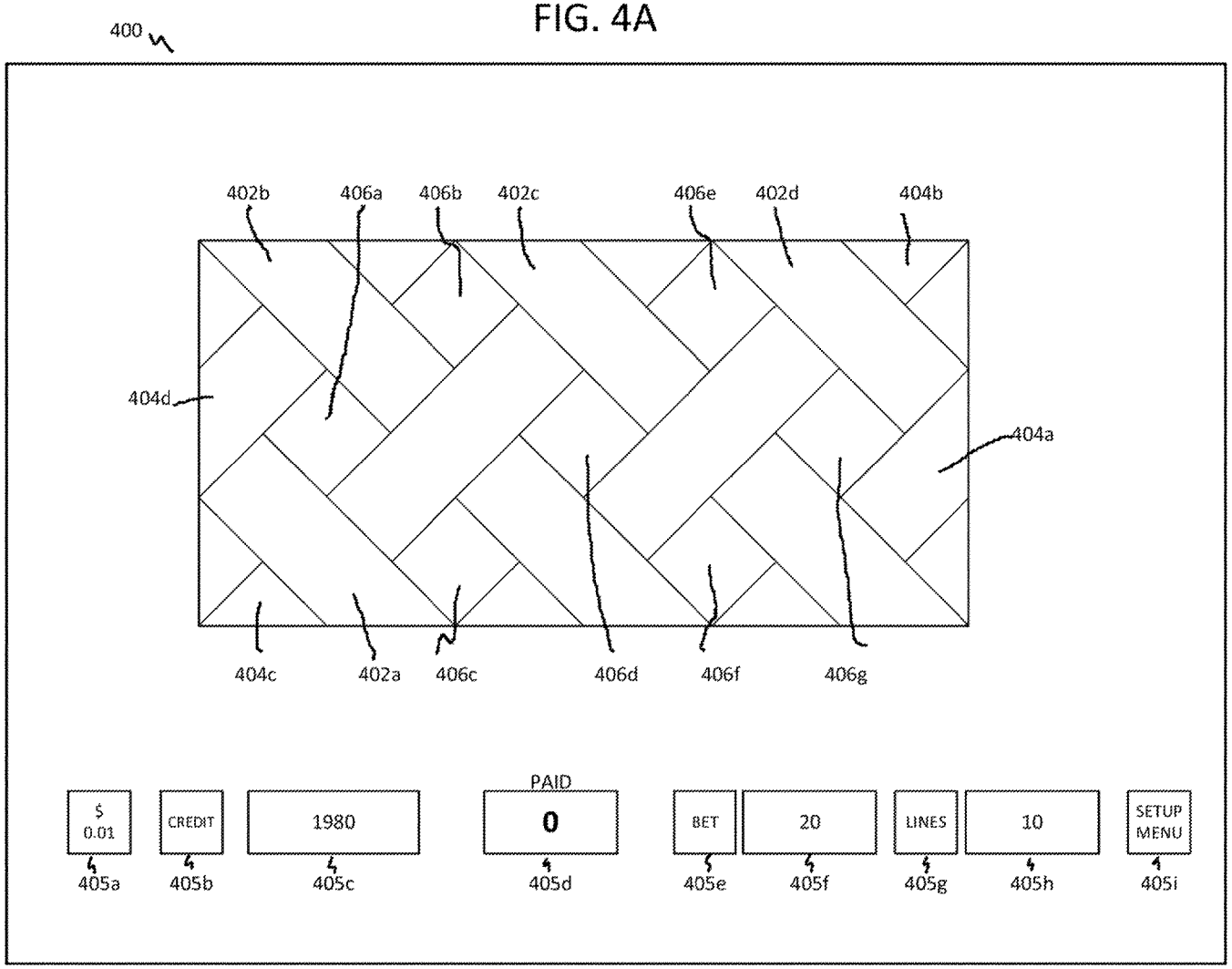
FIGS. 4A, 4B, 4C, 4D, 4E, and 4F illustrate screen shots of one embodiment of a gaming system having interleaved reels.

FIG. 4A illustrates one embodiment of a game display 400 that the gaming device 100 may display on a display device of the gaming system. In one embodiment, game display 400 may be displayed on first display 122 of gaming device 100 illustrated in FIG. 1. However, any other suitable display may be used. The game display 400 displays a plurality of sets of virtual video slot machine reels. For example, game display 400 displays a first set of a plurality of virtual video slot machine reels 402*a*, 402*b*, 402*c*, and 402*d* (e.g., the first set of reels) as illustrated in FIG. 4A a play of a game. In some embodiments, the gaming system generates and displays a different quantity of symbols for some of the first set of reels. In alternative embodiments, the gaming system may generate and display the same quantity of symbols for some of the first set of reels. Game display 400 displays a second set of a plurality of virtual video slot machine reels 404*a*, 404*b*, 404*c*, and 404*d* (e.g., the second set of reels) as illustrated in FIG. 4A for a play of the game. In some embodiments, the gaming system generates and displays a different quantity of symbols for some of the second set of reels. In alternative embodiments, the gaming system may generate and display the same quantity of symbols for some of the second set of reels. Game display 400 also displays a third set of a plurality of virtual video slot machine reels 406*a*, 406*b*, 406*c*, 406*d*, 406*e*, 406*f*, and 406*g* (hereafter, the third set of reels) as illustrated in FIG. 4A for a play of the game. In some embodiments, the gaming system generates and displays the same quantity of symbols for this third set of reels. In alternative embodiments, the gaming system may generate and display a different quantity of symbols for some of the third set of reels. It should be appreciated that fewer or additional reels can be used. Examples of the symbols generated and displayed on the reels are illustrated below. In some embodiments, the plurality of symbol sets for the third plurality of reels consists of special symbols (e.g., Wild, Scatter, etc.). In some embodiments, the plurality of symbol sets for the third plurality of reels comprises both special symbols and pay symbols.

As illustrated in FIG. 4A, the gaming system generates and displays the first set of reels 402*a*, 402*b*, 402*c*, and 402*d* at an angle downward from the left side of the display screen to the right side of the display screen in one embodiment. In some embodiments, gaming system displays the first set of reels 402*a*, 402*b*, 402*c*, and 402*d* at substantially the same angle. It should be appreciated that any suitable angle can be used. The gaming system also displays the first set of reels 402*a*, 402*b*, 402*c*, and 402*d* spaced apart from each other. As also illustrated in FIG. 4A, the gaming system may generate and display a second set of reels 404*a*, 404*b*, 404*c*, and 404*d* at an angle upwards from the left side of the display screen to the right side of the display screen in some embodiments. In some embodiments, gaming system displays the second set of reels 404*a*, 404*b*, 404*c*, and 404*d* at substantially the same angle. It should be appreciated that any suitable angles can be used for the reels. The gaming system also displays the second set of reels 404*a*, 404*b*, 404*c*, and 404*d* spaced apart from each other.

In some embodiments, the gaming system generates the reels as interleaved with each other. For example, some of the first set of reels 402*a*, 402*b*, 402*c*, and 402*d* and some of the second set of reels 404*a*, 404*b*, 404*c*, and 404*d* are interleaved with each other, as is illustrated in FIG. 4A. In some embodiments, the interleaved reels are positioned substantially perpendicular with other reels. As illustrated in FIG. 4A, reel 402*a* is interleaved with reels 404*c* and 404*d*, such that reel 402*a* crosses over reel 404*c* and crosses under reel 404*d*. Reel 402*b* is interleaved with reels 404*b*, 404*c*, and 404*d*, such that reel 402*b* crosses over reel 404*b*, crosses under reel 404*c*, and crosses over reel 404*d*. Reel 402*c* is interleaved with reels 404*a*, 404*b*, and 404*c*, such that reel 402*c* crosses over reel 404*a*, crosses under reel 404*b*, and crosses over reel 404*c*. Reel 402*d* is interleaved with reels 404*a* and 404*b*, such that reel 402*d* crosses under reel 404*a* and crosses over reel 404*b*. Thus, in some embodiments, some of the first set of reels 402*a*, 402*b*, 402*c*, and 402*d* and some of the second set of reels 404*a*, 404*b*, 404*c*, and 404*d* are interleaved in a weave or lattice like pattern. It should be appreciated that any suitable pattern or weave can be used. In some embodiments, at least some of the first set of reels 402*a*, 402*b*, 402*c*, and 402*d* and some of the second set of reels 404*a*, 404*b*, 404*c*, and 404*d* may not be interleaved.

In some embodiments, the interleaved first set of reels 402*a*, 402*b*, 402*c*, and 402*d* and second set of reels 404*a*, 404*b*, 404*c*, and 404*d* form a plurality of unused spaces in display area 400. In some embodiments, the gaming system may generate a plurality of additional reels for some or all of these unused spaces. As illustrated in FIG. 4A, in some such embodiments, the gaming system generates a third set of reels 406*a*, 406*b*, 406*c*, 406*d*, 406*e*, 406*f*, and 406*g* that are positioned in the unused spaces of display area 400 between at least some of the interleaved reels of the first set of reels and the second set of reels. For example, the gaming system generated reel 406*a* that is surrounded on four sides by reel 402*a*, 402*b*, 404*c*, and 404*d*. The gaming system also generated reel 406*b* that is surrounded on four sides by 402*b*, 402*c*, 404*c*, and 404*d*; reel 406*c* that is surrounded on four sides by 402*a*, 402*b*, 404*b*, and 404*c*; reel 406*d* that is surrounded on four sides by 402*b*, 402*c*, 404*b*, and 404*c*; reel 406*e* that is surrounded on four sides by 402*c*, 402*d*, 404*b*, and 404*c*; reel 406*f* that is surrounded on four sides by 402*b*, 402*c*, 404*a*, and 404*b*; and reel 406*g* that is surrounded on four sides by 402*c*, 402*d*, 404*a*, and 404*b*.

While FIG. 4A displays the gaming system generating 15 reels, it should be appreciated that the gaming system may generate any suitable number of reels and any suitable number of different sets of reels. It should be appreciated that reels can be displayed with any suitable amount of separation or no separation. It should be appreciated that the game shown in game display 400 is merely representative and may have more or fewer game elements (e.g., reels, symbol display areas, symbols, etc.) than are shown in the game display 400.

In some embodiments, the plurality of displayed reels are each associated with a set of symbols, where each set of symbols includes a plurality of symbols. Each set of symbols can be associated with the same or a different plurality of symbols. In some embodiments, each set of symbols associated with the first set of reels 402*a*, 402*b*, 402*c*, and 402*d*, respectively, comprise the same symbols. In some embodiments, some sets of symbols associated with the first set of reels 402*a*, 402*b*, 402*c*, and 402*d*, respectively, comprise different symbols from the other sets of symbols from the first set of reels 402*a*, 402*b*, 402*c*, and 402*d*. In some embodiments, each set of symbols associated with the second set of reels 404*a*, 404*b*, 404*c*, and 404*d*, respectively, comprise the same symbols. In some embodiments, some sets of symbols associated with the second set of reels 404*a*, 404*b*, 404*c*, and 404*d*, respectively, comprise different symbols from the other sets of symbols from the second set of reels 404*a*, 404*b*, 404*c*, and 404*d*. In some embodiments, each set of symbols associated with the third set of reels 406*a*, 406*b*, 406*c*, 406*d*, 406*e*, 406*f*, and 406*g* respectively, comprise the same symbols. In some embodiments, some sets of symbols associated with the third set of reels 406*a*, 406*b*, 406*c*, 406*d*, 406*e*, 406*f*, and 406*g* respectively, comprise different symbols from the other sets of symbols from the third set of reels 406*a*, 406*b*, 406*c*, 406*d*, 406*e*, 406*f*, and 406*g*.

The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the sets of symbols may include pay symbols and special or designated symbols. In one embodiment, at least one predetermined symbol is a triggering symbol for a bonus game. In one embodiment, at least one triggering symbol must be generated on the reels during a play of a game to trigger the bonus game. In some embodiments, a plurality of triggering symbols must be generated on the reels during a play of a game to trigger the bonus game. In one embodiment, any one of the symbols in the sets of symbols can be designated as the predetermined triggering symbol. The triggering symbol may be associated with one function (e.g., triggering a bonus game), but may alternatively be associated with a plurality of different game functions. The triggering symbol may be a scatter symbol in some embodiments. In some embodiments, generated triggering symbols are not required to trigger a bonus game.

Each reel may include a plurality of symbol display areas (also referred to herein as symbol display positions). These plurality of symbol display areas can be associated in a manner that provides the appearance of reels. It should also be appreciated that the symbol display areas may not be associated with reels in some embodiments. In the illustrated figures, the symbol display positions are not explicitly shown. In some embodiments, symbol display areas can be associated in a manner that provides the appearance of a set of reels. In some embodiments, symbol display areas can be associated in a manner that provides the appearance of interleaved video slot machine game reels. As is illustrated below, each reel may include one, two, three, or four symbol display areas. It should be appreciated that in different embodiments, the reels may include any suitable number of symbol display areas. In some embodiments, the symbol display areas are illustrated with defined boxes (not shown). However, it should be appreciated that in some embodiments, the defined boxes are not visible to the player. It should also be appreciated that in some embodiments, the symbol display areas are other shapes or not defined shapes and may not be associated with reels.

Game display 400 also includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 200 credits, wagering 20 credits for each of 10 pay lines. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

Figure 4B:
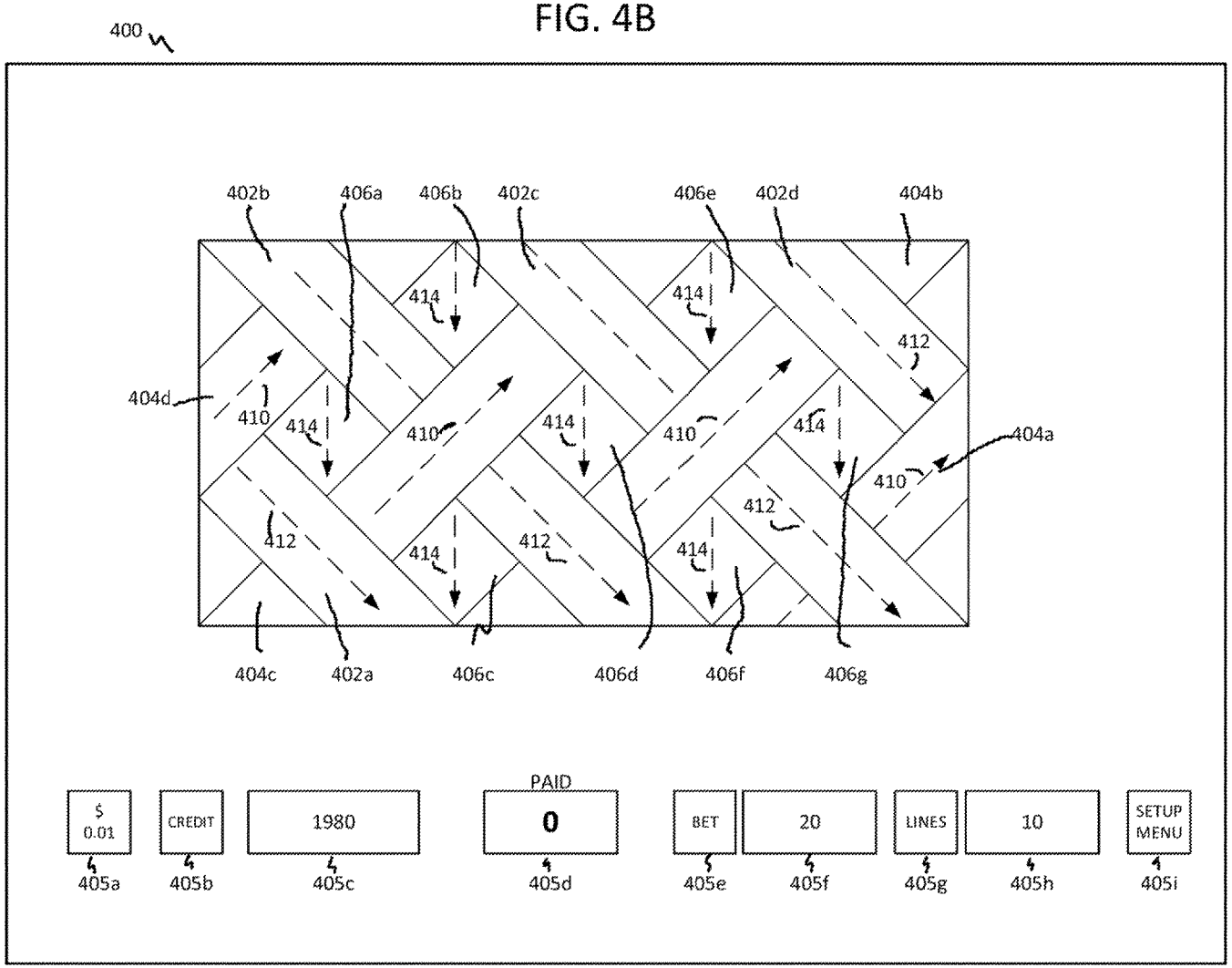

Turning to FIG. 4B, in one embodiment, the reels may be shown spinning in a plurality of different directions to simulate slot machine reels. In some embodiments, the reels can be shown spinning in one direction to simulate slot machine reels. However, it should be appreciated that the reels may be shown spinning in any suitable direction. As illustrated in FIG. 4B, the first set of reels 402*a*, 402*b*, 402*c*, and 402*d* are shown with a spin direction 412 that is the same for the reels in the first set. It should be appreciated that in alternative embodiments, the first set of reels 402*a*, 402*b*, 402*c*, and 402*d* can spin in different directions. As illustrated in FIG. 4B, the second set of reels 404*a*, 404*b*, 404*c*, and 404*d* are shown with a spin direction 410 that is the same for the reels in the second set. It should be appreciated that in alternative embodiments, the second set of reels 404*a*, 404*b*, 404*c*, and 404*d* can spin in different directions. As also illustrated in FIG. 4B, the third set of reels 406*a*, 406*b*, 406*c*, 406*d*, 406*e*, 406*f*, and 406*g* are shown with a spin direction 414 that is the same for the reels in the third set. It should be appreciated that in alternative embodiments, the third set of reels 406*a*, 406*b*, 406*c*, 406*d*, 406*e*, 406*f*, and 406*g* can spin in different directions. Thus, it should be appreciated that during a play of a game, the gaming system may generate a unique display of symbols spinning on interleaved sets of reels.

Figure 4C:
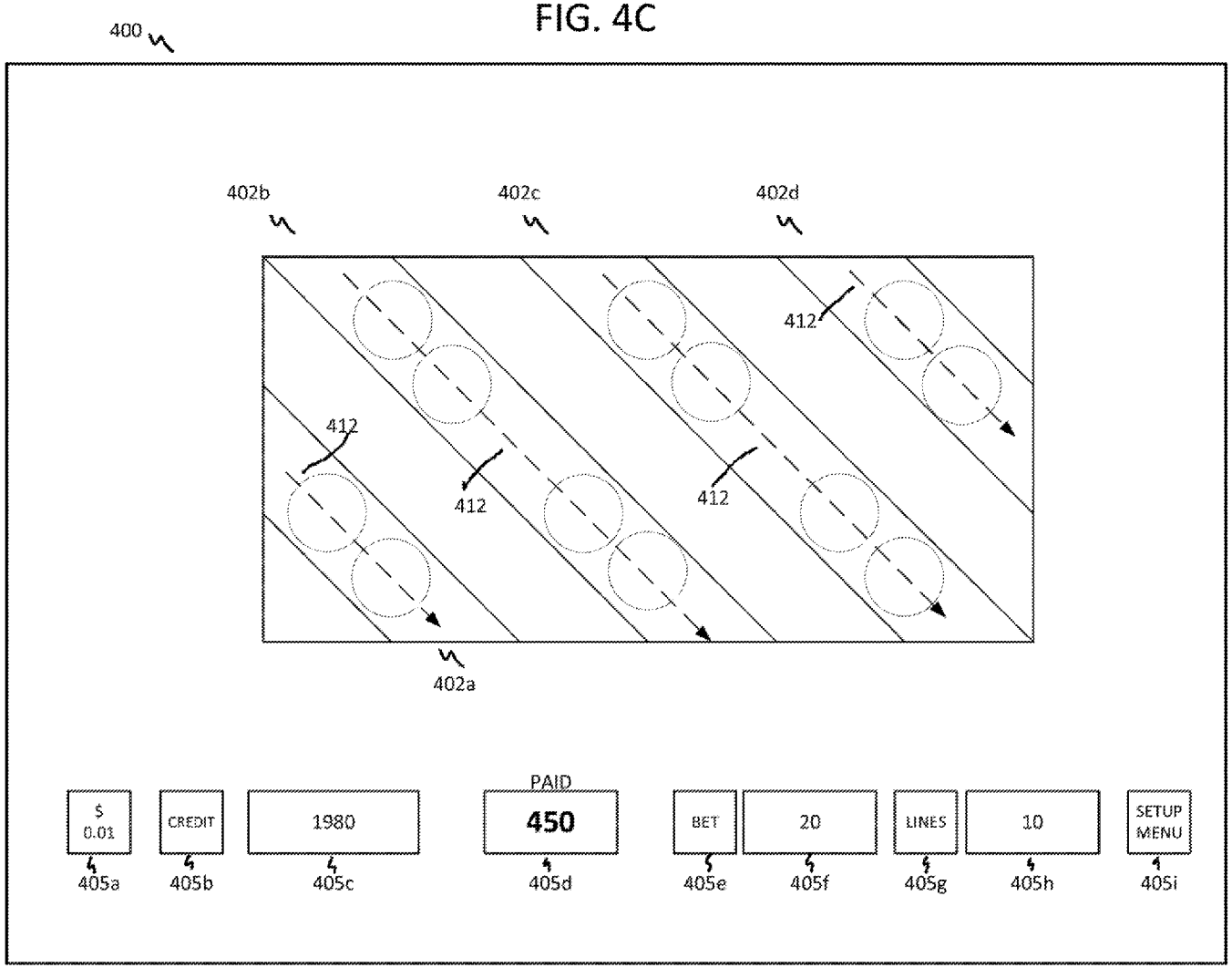
Figure 4D:
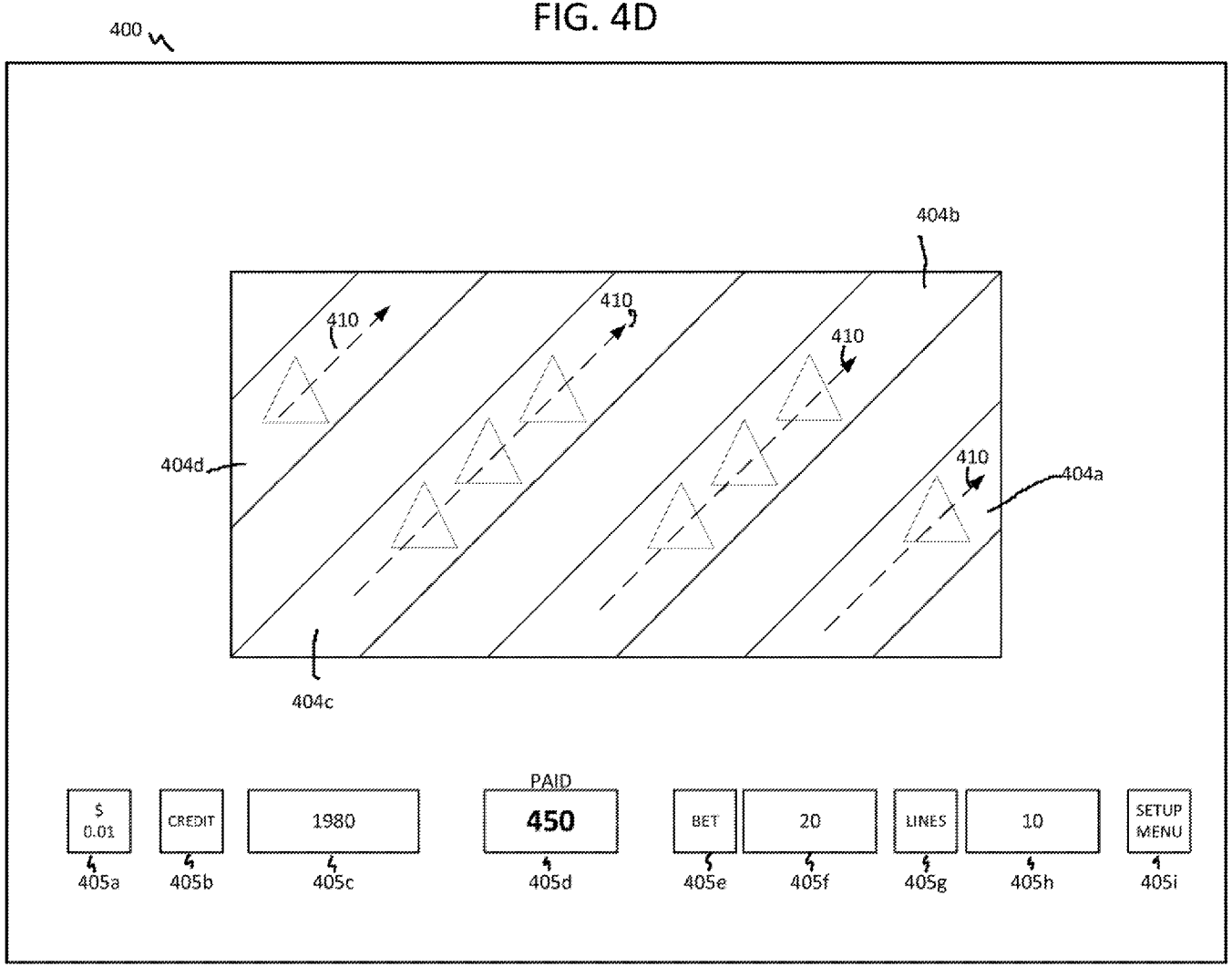
Figure 4E:
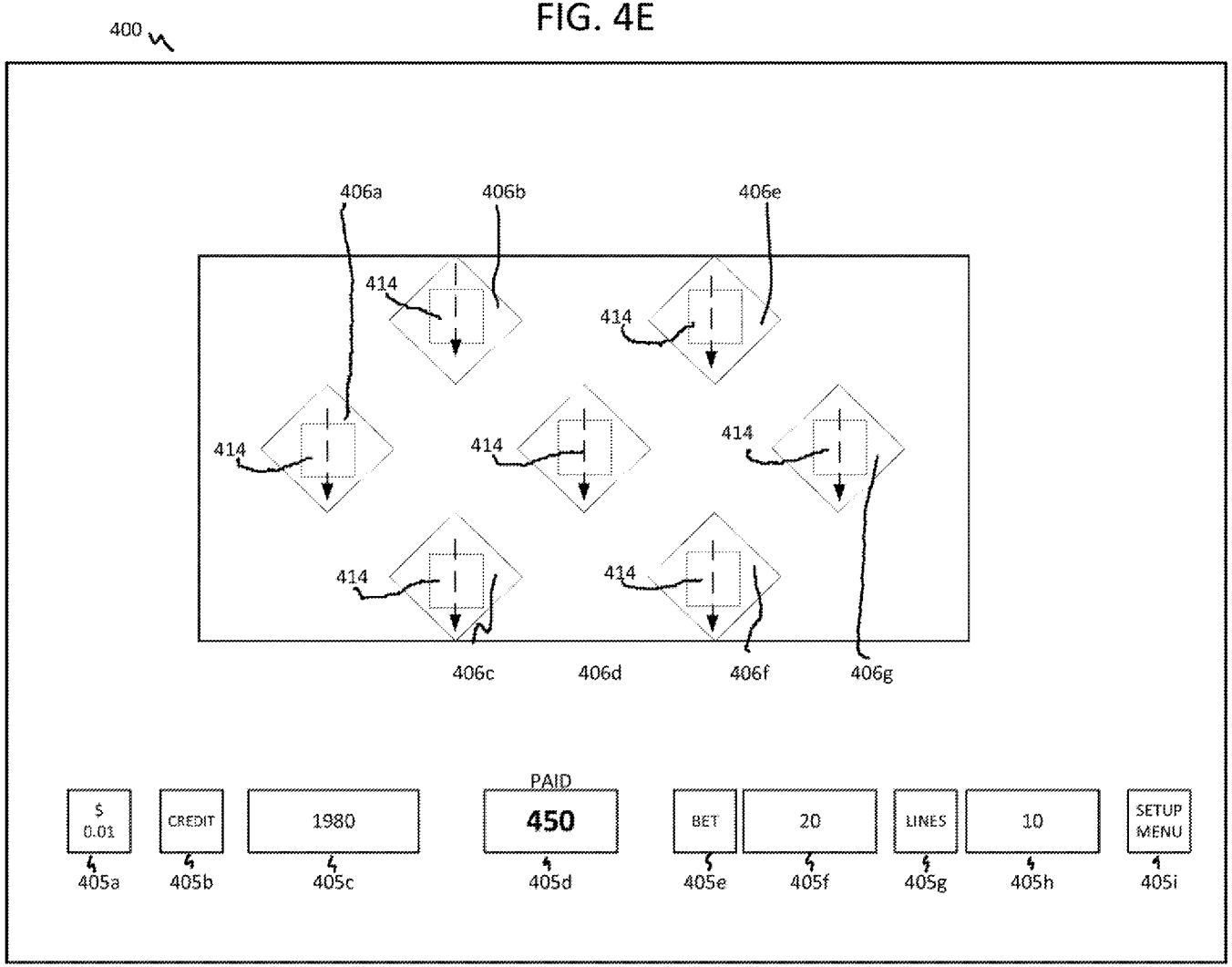

Turning to FIGS. 4C-4E, the game display 400 is illustrated with a different one of the sets of reels for each of FIGS. 4C, 4D, and 4E for ease of understanding how all of the individual sets of reels are generated. In some embodiments, the gaming system may show the players the individual set of reels so that the player can understand how the symbols are distributed for each set of reels. However, in some embodiments, the gaming system does not show the players the individual set of reels as is illustrated in FIGS. 4C, 4D, and 4E.

In FIG. 4C, the game display 400 illustrates the first set of reels 402*a*, 402*b*, 402*c*, and 402*d* and the reel spins direction 412 of the first set of reels. As illustrated in FIG. 4C, the first set of reels 402*a*, 402*b*, 402*c*, and 402*d* are displayed at an angle and are spaced apart from each other. The circle symbols are used in FIG. 4C merely as illustration tools to represent how many symbols the gaming system generates on a given reel and where the symbols can be placed on the given reel in some embodiments. The gaming system may generate any suitable symbols on the reels. In some embodiments, the gaming system generates reel 402*a* with two symbols. In some embodiments, reel 402*a* includes two symbol display areas. In some embodiments, the gaming system generates reel 402*b* with four symbols. In some embodiments, reel 402*b* includes four symbol display areas. In some embodiments, the displayed symbols on reel 402*b* may be separated with a gap. In some embodiments, the gap represents an area that is covered by another reel (e.g., an interleaved reel). In some embodiments, the gaming system generates a fifth symbol in the area with the gap that may or may not be visible when covered by the other reel. In some embodiments, the gaming system generates reel 402*c* with four symbols. In some embodiments, reel 402*c* includes four symbol display areas. In some embodiments, the displayed symbols on reel 402*c* may be separated with a gap. In some embodiments, the gap represent an area that is covered by another reel (e.g., an interleaved reel). In some embodiments, the gaming system generates a fifth symbol in the area with the gap that may or may not be visible when covered by the other reel. In some embodiments, the gaming system generates reel 402*d* with two symbols. In some embodiments, reel 402*d* includes two symbol display areas. It should be appreciated that if the symbols sizes are changed or the display size is changed, the gaming system may generate and display fewer or additional symbols on the first set of reels.

In FIG. 4D, the game display 400 illustrates the second set of reels 404*a*, 404*b*, 404*c*, and 404*d* and the reel spins direction 412 of the second set of reels. As illustrated in FIG. 4D, the second set of reels 404*a*, 404*b*, 404*c*, and 404*d* are displayed an angle (different from the first set of reels) and are spaced apart from each other. The triangle symbols are used in FIG. 4D merely as illustration tools to represent how many symbols the gaming system generates on a given reel and where the symbols can be placed on the given reel in some embodiments. The gaming system may generate any suitable symbols on the reels. In some embodiments, the gaming system generates reel 404*a* with one symbol. In some embodiments, reel 404*a* includes one symbol display area. In some embodiments, the gaming system generates reel 404*b* with three symbols. In some embodiments, reel 404*b* includes three symbol display areas. In some embodiments, the displayed symbols on reel 404*b* may include empty areas on the top and bottom of the reels that do not include symbols. In some embodiments, the empty areas represent areas that are covered by other reels (e.g., interleaved reels). In some embodiments, the gaming system generates additional symbols in these empty areas that may or may not be visible when covered by the other reels. In some embodiments, the gaming system generates reel 404*c* with three symbols. In some embodiments, reel 404*c* includes three symbol display areas. In some embodiments, the displayed symbols on reel 404*c* may include empty areas on the top and bottom of the reels that do not include symbols. In some embodiments, the empty areas represent areas that are covered by other reels (e.g., interleaved reels). In some embodiments, the gaming system generates additional symbols in these empty areas that may or may not be visible when covered by the other reels. In some embodiments, the gaming system generates reel 404*d* with one symbol. In some embodiments, reel 404*d* includes one symbol display area. It should be appreciated that if the symbols sizes are changed or the display size is changed, the gaming system may generate and display fewer or additional symbols on the second set of reels.

In FIG. 4E, the game display 400 illustrates the third set of reels 406*a*, 406*b*, 406*c*, 406*d*, 406*e*, 406*f*, and 406*g* and the reel spins direction 414 of the third set of reels. As illustrated in FIG. 4E, the third set of reels 406*a*, 406*b*, 406*c*, 406*d*, 406*e*, 406*f*, and 406*g* are displayed an angle (different from the first set of reels and the second set of reels) and are spaced apart from each other. The square symbols are used in FIG. 4E merely as illustration tools to represent how many symbols the gaming system generates on a given reel and where the symbols can be placed on the given reel in some embodiments. The gaming system may generate any suitable symbols on the reels. In some embodiments, the gaming system generates reels 406*a*, 406*b*, 406*c*, 406*d*, 406*e*, 406*f*, and 406*g* each with one symbol. In some embodiments, one or more of reels 406*a*, 406*b*, 406*c*, 406*d*, 406*e*, 406*f*, and 406*g* may display more than one symbol. It should be appreciated that if the symbols sizes are changed or the display size is changed, the gaming system may generate and display fewer or additional symbols for the third set of reels.

Figure 4F:
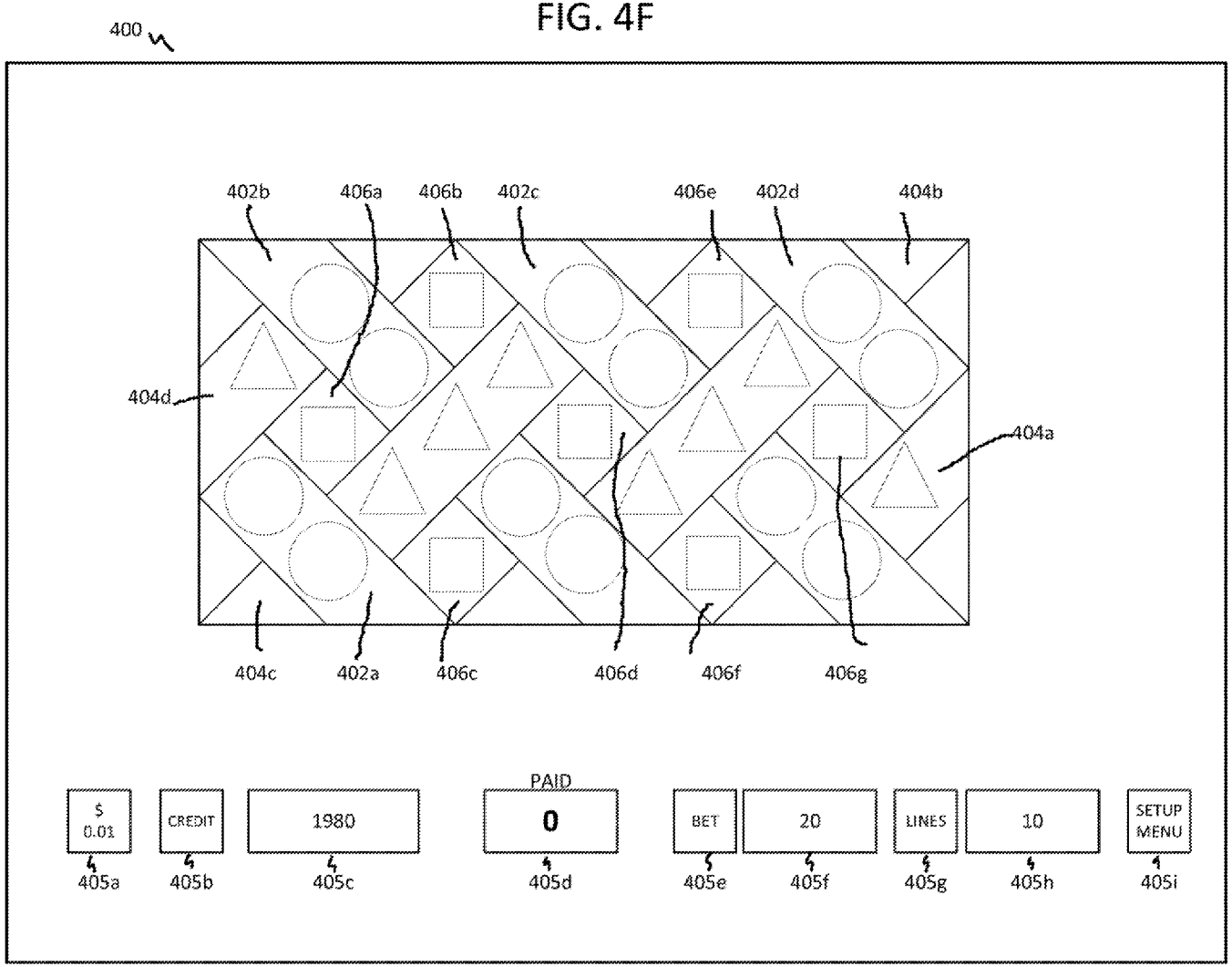

FIG. 4F illustrates the reels displayed in FIGS. 4C-4E with the place holder circle, triangle, and square symbols. FIG. 4F illustrates one embodiment of the interleaved first set of reels and the second set of reels. FIG. 4F also illustrates one embodiment of the third set of reels displayed in areas between the interleaved first set of reels and the second set of reels. The displayed circle, triangle, and square symbols are illustrated in the substantially the same positions as illustrated in the prior FIGS. 4C, 4D, and 4E.

It should be appreciated that a gaming system having interleaved reels allows more reels and more symbols to be displayed than is possible on a typical gaming system display, without having to use a larger display or substantially shrink the size of the displayed symbols. A gaming system having interleaved reels also enables the use of a variety of new pay lines that were not previously possible, such as vertical pay lines and pay lines that can start from any border or side around displayed symbols. As illustrated in FIG. 4A-4F, a gaming system with 15 reels in the unique interleaved layout also creates the potential for both a greater number of available pay lines and for some of such pay lines to be a greater length than is possible in a typical five reel by three row reel game. Thus, such a gaming system provides a potential to create more opportunities for a player to achieve winning outcomes. It should be appreciated that the gaming system is not limited to 15 reels; the gaming system may comprise more or fewer reels. In some embodiments, the orientation of the reels in FIGS. 4A-4F can further be rotated 90 degrees to accommodate different physical display screen layouts.

Figure 5A:
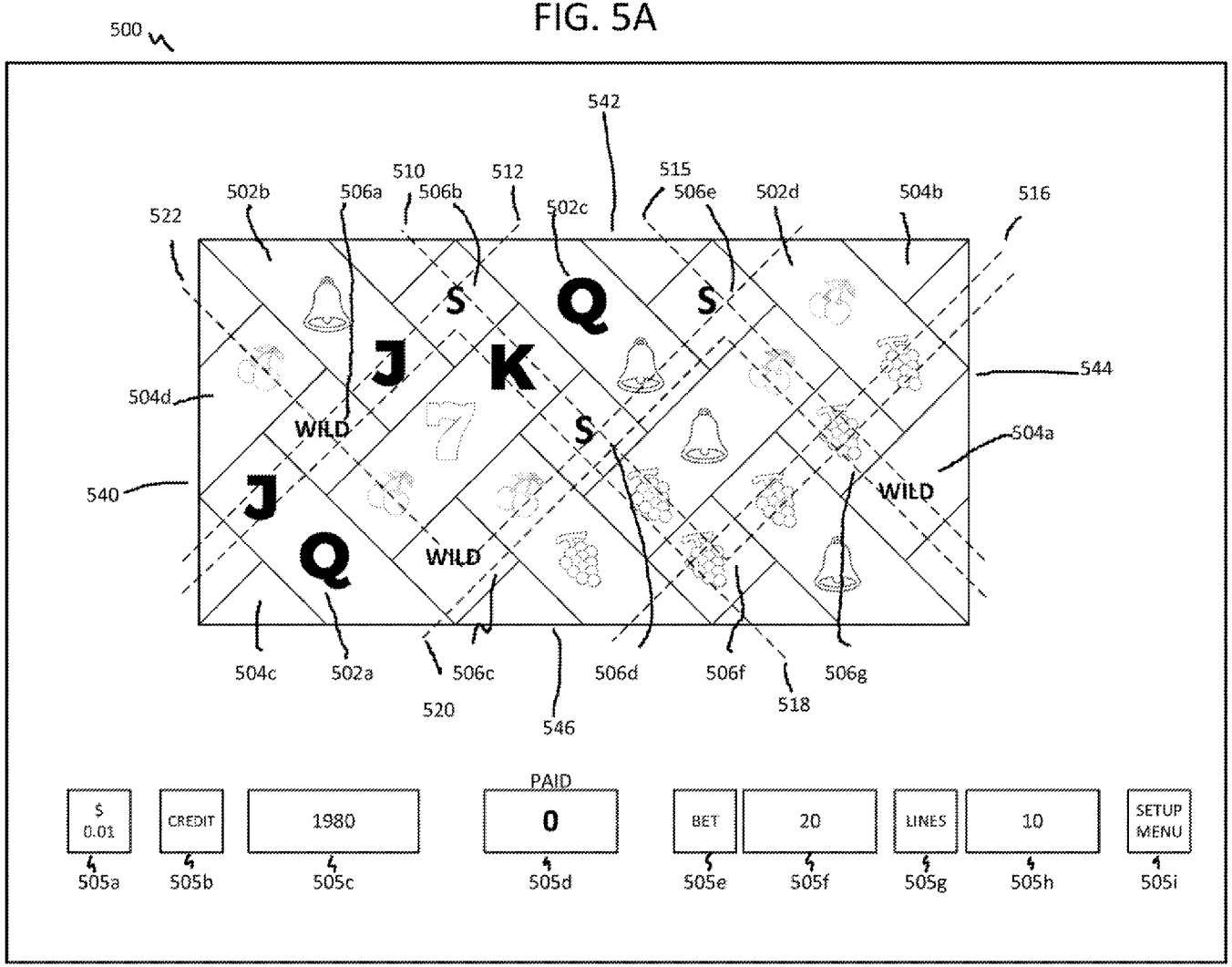
FIGS. 5A and 5B illustrates screen shots of one embodiment of a gaming system having interleaved reels and certain available pay lines.
Figure 5B:
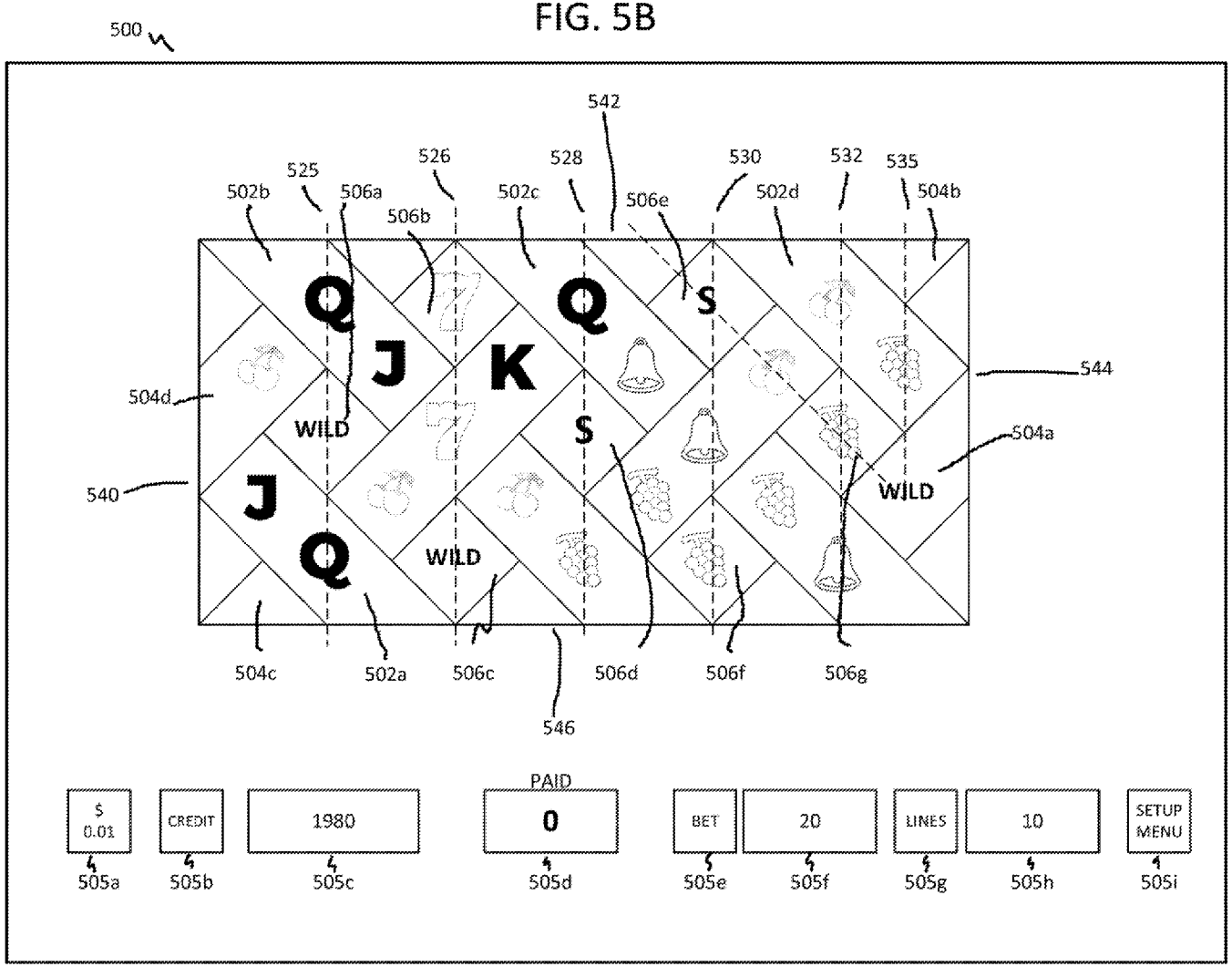

Turning to FIGS. 5A and 5B, one embodiment is illustrated where the gaming system generated the first, second, and third set of reels and a plurality of symbols for these reels. The game display 400 also illustrates some embodiments of possible pay lines that the gaming system uses to evaluate the generated symbols for winning symbol combinations. It should be appreciated that more or fewer pay lines can be used in a play of the game.

In the embodiment illustrated in FIG. 5A, to start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*.

To initiate a play of a game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Upon receipt of the player's wager and activation of the game start button, the gaming system may show a display of spinning reels (not shown) for each of the reels (such as displayed reels 402*a*-402*d*, 404*a*-404*d*, and 406*a*-406*g* from FIG. 4A). The spinning may appear to occur in directions discussed previously in FIG. 4B or in other suitable directions. In one embodiment, the gaming system randomly generates symbols from the associated sets of symbols for the reels in the reel sets. As noted above, the gaming system may rely on random generation performed by a pseudo RNG, a true RNG, or hardware RNG specifically designed for gaming systems. In one embodiment, the gaming system may also update the player's credit meter (information area 505*c*) to reflect the player's available credit balance. As shown in FIG. 5A, the player's credit meter (information area 505*c*) was decremented by 200 credits from 2180 to 1980 to reflect the 200 credit wager the player placed for the play of the game.

The gaming system displays the generated symbols in symbol display areas of the reels as illustrated in FIG. 5A. Symbols displayed on reels illustrate the randomly generated symbols from the set of symbols after the reels have stopped spinning. As illustrated in FIG. 5A, the gaming system randomly generated and displayed a plurality of symbols. For the first set of reels, the gaming system generated and displayed a Jack and a Queen symbol on reel 502*a*; a Bell, a Jack, a Cherry, and a Grape symbol on reel 502*b*; a Queen, a Bell, a Grape, and a Bell symbol on reel 502*c*; and a Cherry and a Grape symbol on reel 502*d*. For the second set of reels, the gaming system generated and displayed a Wild symbol on reel 504*a*; a Cherry, a Bell, and a Grape symbol on reel 504*b*; a King, a Seven, and a Cherry symbol on reel 504*c*; and a Cherry symbol on reel 504*d*. For the third set of reels, the gaming system generated a Wild symbol on reel 506*a*, a Scatter symbol on reel 506*b*, a Wild symbol on reel 506*c*, a Scatter symbol on reel 506*d*, a Scatter symbol on reel 506*e*, a Grape symbol on reel 506*f*, and a Grape symbol on reel 506*g*. It should be appreciated that the displayed symbol combinations are merely for explanatory purposes and the gaming system may randomly generate any suitable combination of symbols based on defined symbol sets associated with the reels.

FIG. 5A further illustrates one embodiment of a gaming system executing an evaluation of the generated symbols on the reels for winning symbol combinations. As noted above, the player may have wagered on one or more pay lines (such as 10 pay lines shown in information area 505*h*). In one embodiment, the gaming system evaluates at least the active (wagered on pay lines) for winning symbol combinations. In one embodiment, the gaming system limits its evaluation to active pay lines to more efficiently use processor, memory, and power resources by performing fewer calculations to determine winning symbol combinations. In some embodiments, the gaming system may evaluate all available pay lines for winning symbol combinations. Any suitable number of pay lines may be used to evaluate winning symbol combinations.

As illustrated in FIG. 5A, a small quantity of example pay lines are shown in phantom (dotted) lines for some embodiments. In some embodiments, the gaming system evaluates pay lines starting from different sides of the displayed symbols based on one or more pay tables (not shown). For example, in some embodiments, the gaming system may evaluate symbols starting from left side 540. In alternative embodiments, the gaming system may evaluate symbols starting from top side 542. In other embodiments, the gaming system may evaluate symbols starting from right side 544. In other embodiments, the gaming system may evaluate symbols starting from bottom side 546. In various embodiments, the gaming system may evaluate different pay lines starting from any of such sides of the displayed symbols. For example, pay line 510 begins at the top side 542, thus the gaming system evaluates symbols on the pay line 510 starting from reel 506*b* and spanning across reels 504*c*, 506*d*, 504*b*, 506*f*, 502*c*, 506*g*, and 502*d*. In this example, pay line 510 did not result in any winning symbol combinations because the consecutive Grape symbols were displayed on the back portion of the pay line. However, pay line 516 begins at the right side 544 and spans across reels 502*d*, 506*g*, 502*c*, and 506*f* In this example pay line 516, the gaming system may determine that a winning symbol combination is formed because the four consecutive Grape symbols were generated and displayed from the starting point of pay line 516. The gaming system may perform similar evaluations from each of sides 540, 542, 544, and 546 for pay lines 510, 512, 514, 516, 518, 520, and 522 in some embodiments.

In some embodiments, a pay line must span across different adjacent reels for each adjacent symbol, such as shown in the illustrated pay lines in FIG. 5A. For example, in some embodiments, the gaming system does not includes a pay line spanning across the Bell and Jack symbol of reel 502*b*, the Seven symbol from interleaved reel 504*c*, and back to the Cherry symbol and Grape symbol on 502*b* because the Bell and Jack symbols and the Cherry and Grape symbols are on reel 502*b*.

In some embodiments, two or more of the displayed reels can be formed as a continuous reel. For example, reels 502*a*, 502*b*, 502*c*, and 502*d* may be formed as a continuous reel. The gaming system may generate the symbols for this continuous reel from the same symbol set in one embodiment. In such an embodiment, one or more pay lines may span across the same continuous reel. For example, pay line 512 may span across reel segment 502*a* and reel segment 502*b* of the same continuous reel in one embodiment. In some embodiments, the continuous reel can comprise smaller segments of the displayed reels (e.g., reels 502*a* and 502*b*). It should be appreciated that any two or more of the displayed reels can be used to form the continuous reel. In some embodiments, the gaming system may comprise two or more continuous reels.

Turning to FIG. 5B, the game display 400 illustrates some additional possible pay lines. Due to the unique reel configurations comprising interleaved reels and reels positioned in spaces between the interleaved reels, vertical pay lines are possible. It should be appreciated that in a traditional reel layout consisting of adjacent substantially vertical reels, vertical pay lines are not practical because the pay line would only span across a single reel. However, with the disclosed interleaved reels and reels positioned in spaces between the interleaved reels, the gaming system can be configured with substantially vertical pay lines because such pay lines would span across different reels (e.g., each adjacent symbol in a winning symbol combination is displayed on a different reel). As illustrated in FIG. 5B, pay line 525 crosses reels 502*b*, 506*a*, and 502*a*; pay line 526 crosses reels 506*b*, 504*c*, and 506*c*; pay line 528 crosses reels 502*c*, 506*d*, and 502*b*, pay line 530 crosses reels 506*e*, 504*b*, and 506*f*; pay line 532 crosses reels 502*d*, 506*g*, and 502*c*. Pay line 534 illustrates an example of a vertical pay line combined with an angled pay line that spans across 502*d*, 505*a*, 506*g*, 504*b*, and 506*e*. As noted above in connection with FIG. 5A, the displayed pay lines are merely examples and the gaming system can be configured with any suitable quantity of pay lines. In some embodiments, the vertical pay lines can be evaluated starting from the top side 542 or from the bottom side 546.

In some embodiments, the point at which interleaved reels cross over or under each other enables the gaming system to further form unique pay line combinations. In some such embodiments, the gaming system may generate more than one symbol for the point at which interleaved reels cross over or under each other. For example, in FIG. 5B, where reel 504*d* crosses under reel 502*b*, the gaming system may generate an extra symbol for reel 504*d* in the same symbol display area as the Queen symbol that the gaming system generated and displayed for reel 502*b*. In some embodiments, the extra symbol for reel 504*d* remains hidden from display. In alternative embodiments, the gaming system partially displays the extra symbol for reel 504*d*. For example, the Queen symbol may be partially transparent such that the extra symbol for reel 504*d* is partially visible under the Queen symbol. In one embodiment, the player must place an additional wager to obtain the extra symbol for reel 504*d*. In other embodiments, the player is not required to place any additional wager to obtain the extra symbol for reel 504*d*. In some embodiments, the gaming system must generate a certain combination of symbols for the extra symbol for reel 504*d* to be available to the player in a play of a game. In some embodiments, the gaming system uses the Queen symbol in 502*b* in a first evaluation of the displayed symbols for winning symbol combinations. In some embodiments, the gaming system performs a second evaluation of the displayed symbols for winning symbol combinations using the extra symbol for reel 504*d* and not the Queen symbol in 502*b*. In alternative embodiments, the gaming system performs a single evaluation of the displayed symbols for winning symbol combinations using either the extra symbol for reel 504*d* or the Queen symbol in 502*b*, using which ever symbol will provide a winning combination of symbols for the player. It should be appreciated that features of extra symbols used in connection with any point at which interleaved reels cross over or under each other and are not limited to reels 502*b* and 504*d*.

By using interleaved reels, the gaming system provides new ways to enhance game outcomes and improve player awards, which reduces potential player disappointment with game outcomes and enhances player excitement for the game. The new potential to improve or earn greater awards creates a greatly improved sense of anticipation of the game for players.

A number of embodiments of the invention have been described. Various modifications may be made without departing from the spirit and scope of the invention. For example, various forms of the flows shown above may be used, with steps or blocks re-ordered, added, or removed. Accordingly, other embodiments are within the scope of the following claims.

I claim:

1. A gaming system comprising:
- a cabinet;
- a processor;
- a display device supported by the cabinet;
- an input device supported by the cabinet;
- a value acceptor supported by the cabinet;
- a value dispenser supported by the cabinet;
- a memory device that stores a plurality of instructions which, when executed by the processor, cause the processor to:
  - establish a credit balance based at least in part on a monetary value received by the value acceptor;
  - place a wager following receipt of a wager input via the input device, the credit balance being decreased by the wager;
  - randomly generate a plurality of symbols from a plurality of symbol sets;
  - display the plurality of symbols on a plurality of reels, where at least two of the plurality of reels are interleaved with each other, and wherein a first one of the plurality of reels displays one symbol in a symbol position that is surrounded by four different adjacent reels;
  - evaluate the plurality of symbols based on a first pay line that starts on a vertical edge of the displayed plurality of symbols and on a second pay line that starts on a horizontal edge of the displayed plurality of symbols;
  - determine any awards based on the plurality of symbols formed along the first pay line and the second pay line;
  - display, on the display device, any determined awards, the credit balance being increased by any determined awards; and
  - issue value from the value dispenser based on the credit balance upon receipt of a cash out signal.

2. The gaming system of claim 1, wherein at least two of the plurality of reels share at least one symbol.

3. The gaming system of claim 1, wherein one reel is interleaved with two other reels of the plurality of reels.

4. The gaming system of claim 1, wherein at least one pay line is substantially vertical.

5. The gaming system of claim 1, wherein at least one of the plurality of reels displays one symbol and a plurality of the other reels display a plurality of symbols.

6. The gaming system of claim 5, wherein the at least one of the plurality of reels displaying one symbol is surrounded by four different adjacent reels.

7. The gaming system of claim 1, wherein at least two of the plurality of reels are interleaved with two more of the plurality of reels.

8. The gaming system of claim 1, wherein a first one of the plurality of reels is displayed in a first angled orientation and a second one of the plurality of reels is displayed in a second different angled orientation.

9. The gaming system of claim 8, wherein the first one of the plurality of reels displayed in the first angled orientation overlaps the second one of the plurality of reels displayed in the second different angled orientation.

10. The gaming system of claim 8, wherein the overlap is in a center of the second one of the plurality of reels displayed in the second different angled orientation.

11. The gaming system of claim 1, wherein the evaluation of the plurality of symbols further comprises at least four different pay lines that start on at least four different sides of the displayed plurality of symbols.

12. The gaming system of claim 1, wherein at least one of the plurality of reels is a continuous reel that intersects another one of the plurality of reels at least twice.

13. The gaming system of claim 12, wherein the evaluation of the plurality of symbols further comprises at one least pay line that spans across the continuous reel over at least two symbol display areas.

14. The gaming system of claim 1, wherein at least two of the plurality of reels share a same symbol display area, but not a symbol in the same symbol display area.

15. The gaming system of claim 1, wherein the quantity of displayed plurality of symbols can be increased without enlarging the display device or substantially shrinking the size of the displayed symbols.

16. The gaming system of claim 1, wherein the at least two interleaved reels of the plurality of reels display symbols that move in directions perpendicular to each other.

17. The gaming system of claim 1, wherein a second one of the plurality of reels displays one symbol in a symbol position that is surrounded by three different adjacent reels.

18. The gaming system of claim 17, wherein the symbol position that is surrounded by four different adjacent reels and the symbol position that is surrounded by three different adjacent reels are displayed along a same pay line.

19. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

randomly generating a plurality of symbols from a plurality of symbol sets;

displaying, on a display device of the gaming system, the plurality of symbols on a plurality of reels, where at least two of the plurality of reels are interleaved with each other, and wherein a first one of the plurality of reels displays one symbol in a symbol position that is surrounded by four different adjacent reels;

evaluating, by the processor, the plurality of symbols based on a first pay line that starts on a vertical edge of the displayed plurality of symbols and on a second pay line that starts on a horizontal edge of the displayed plurality of symbols;

determining any awards based on the plurality of symbols formed along the first pay line and the second pay line;

displaying, on the display device, any determined awards;

increasing, by the processor, the credit balance by any determined awards; and issuing value, by the value dispenser, based on the credit balance upon receipt of a cash out signal.

20. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

randomly generate a plurality of symbols from a plurality of symbol sets;

display, on a display device of the gaming device, the plurality of symbols on a plurality of reels, where at least two of the plurality of reels are interleaved with each other, and wherein a first one of the plurality of reels displays one symbol in a symbol position that is surrounded by four different adjacent reels;

evaluate the plurality of symbols based on a first pay line that starts on a vertical edge of the displayed plurality of symbols and on a second pay line that starts on a horizontal edge of the displayed plurality of symbols;

determine any awards based on the plurality of symbols formed along the first pay line and the second pay line;

display, on the display device, any determined awards;

increase, by the processor, the credit balance by any determined awards; and issue value from a value dispenser based on the credit balance upon receipt of a cash out signal.

* * * * *